US005096806A

United States Patent [19]

Nakamura et al.

[11] Patent Number: 5,096,806

[45] Date of Patent: Mar. 17, 1992

[54] SILVER HALIDE PHOTOGRAPHIC MATERIAL AND PROCESS FOR PRODUCING THE SAME

[75] Inventors: Tetsuo Nakamura; Ichizo Toya, both of Kanagawa, Japan

[73] Assignee: Fuji Photo Film Co., Ltd., Kanagawa, Japan

[21] Appl. No.: 558,360

[22] Filed: Jul. 27, 1990

[30] Foreign Application Priority Data

Jul. 28, 1989 [JP] Japan ..... 1-196028
Oct. 4, 1989 [JP] Japan ..... 1-259464

[51] Int. Cl.[5] ..... G03C 1/035; G03C 1/005
[52] U.S. Cl. ..... 430/567; 430/569
[58] Field of Search ..... 430/567, 569

[56] References Cited

U.S. PATENT DOCUMENTS 4,349,622 9/1982 Koitabashi et al. ..... 430/567
4,463,087 7/1984 Maskasky ..... 430/567
4,806,461 2/1989 Ikeda et al. ..... 430/567
4,917,996 4/1990 Matsuzara et al. ..... 430/567

*Primary Examiner*—Charles L. Bowers, Jr.
*Assistant Examiner*—Janis L. Dote
*Attorney, Agent, or Firm*—Sughrue, Mion, Zinn, Macpeak & Seas

[57] ABSTRACT

A silver halide photographic material comprising a support, and at least one silver halide emulsion layer containing silver halide grains on the support, wherein the silver halide grains have an internal area formed in at least one corner of the grains, the internal area having a silver iodide content higher than the silver iodide content of the circumferential area of the grains. A process for producing a silver halide photographic material which comprises the steps of: (1) adding a first solution containing iodide ions to a second solution containing silver iodobromide host grains; (2) adding the third solution containing silver ions to the mixture from step (1) to form silver halide grains wherein the silver halide grains have (a) an internal area formed in a corner, the internal area having a silver iodide content higher than the silver iodide content of the circumferential area of the grains; and (b) more than 95% of the total projected area of the silver halide grains is tabular silver halide grains, the tabular silver halide grains having (i) two sheets of twin planes parallel to the principal plane, and (ii) a monodisperse size distribution.

13 Claims, 4 Drawing Sheets

SILVER HALIDE PHOTOGRAPHIC MATERIAL AND PROCESS FOR PRODUCING THE SAME

FIELD OF THE INVENTION

This invention relates to a silver halide photographic material, and more particularly to a photographic material having high sensitivity. It also relates to a process for producing a silver halide photographic material.

BACKGROUND OF THE INVENTION

Generally, silver iodobromide emulsions are used for camera-speed sensitivity photographic elements as the sensitive silver halide emulsion. Silver iodobromide grains contain silver iodide in silver bromide crystal lattice in such an amount that the amount of silver iodide is not more than a limiting amount to be dissolved in silver bromide. Such silver iodobromide grains have an iodide content not higher than about 40 mol %. Iodide in silver iodobromide emulsions has the following advantages and disadventages.

Advantageously, it increases the efficiency of latent image formation; increase the amount of light absorbed (inherent absorption of the silver halide); improves the adsorption of additives; and improves graineness.

Disadvantageously, iodide restrains development and inhibits chemical sensitization.

Heretofore, many studies have been done with the view of increasing the advantages and decreasing the disadvantages of silver iodobromide photographs having camera-speed sensitivity. The position where the silver iodide was located in the silver halide emulsion grains was found to be of great importance. The following description is found in G. F. Duffin, *Photographic Emulsion Chemistry* (The Focal Press 1966) page 18.

"An important factor to be considered is the position of iodide when the emulsions are silver iodobromide emulsions. The iodide can be located chiefly in the central part of its crystal or chiefly on the outer surface thereof. The actual position of the iodide varies depending on the preparation conditions of the emulsions. The position influences clearly the physical and chemical characteristics of the crystal."

In the single jet process (wherein the whole amounts of both an iodide salt and a bromide salt are allowed to exist in a reaction vessel and an aqueous solution of a silver salt is then introduced into the reaction vessel to form silver iodobromide grains), silver iodide is first precipitated out and hence silver iodide tends to concentrate in the center of grains.

In the double jet process (wherein both the iodide and the bromide together with the silver salt are simultaneously introduced into the reaction vessel), the distribution of silver iodide in the grains can be controlled. For example, silver iodide can be uniformly iodide on the outer surfaces of grains or a silver iodide shell having a high silver iodide content can be formed when the amount of the bromide salt to be added is reduced or stopped on the way to the formation of grains and the addition of the iodide salt is continued.

The essentials of forming such non-uniform grains are disclosed in JP-A-58-113927 (the term "JP-A" as used herein means an "unexamined published Japanese patent application"}, JP-A-59-99433, JP-A-60-147727, JP-A-60-14331 and JP-A-61-245151. Such grains show improved photographic characteristics compared to uniform grains merely changing the silver iodide content depending on the position of individual grains (particularly in the interior or exterior of grains).

Many methods are known for improving photographic performance such as changing sensitivity by epitaxial-depositing a silver salt on the chosen surface sites of silver halide host grains. For example, JP-A-58-108526 and JP-A-59-133540 disclose silver halide emulsions wherein a silver salt is arranged on the chosen sites of tabular or non-tabular silver halide host grains.

In the many examples disclosed in these patent specifications, however, a silver salt having relatively high solubility (e.g., silver chloride) is formed on the host grains of silver halide having relatively low solubility (e.g., silver iodobromide) by epitaxial growth. However, it is difficult to epitaxially-grow a silver salt having relatively low solubility (e.g., silver iodobromide having a low silver iodide content) on the host grains of silver halide that have a relatively high solubility (e.g., silver iodobromide having a high silver iodide content). In these patent specifications, it is also necessary that sensitizing dyes or ions, as site indicators, capable of being easily adsorbed on the specific plane of crystal be added before the epitaxial growth of the silver salt.

In the method described in JP-A-62-319740, monodisperse tabular grains are prepared and while a high-contrast gradation can be produced photographic material having excellent high-speed development characteristics cannot be provided.

SUMMARY OF THE INVENTION

The present inventors have found that silver halide grains having an internal area formed in the corner of a grain, where this internal area has a silver iodide content higher than that of the circumferential area of this grain, can be used to produce a silver halide photographic material having high photographic sensitivity. These grains are formed when a first solution containing an iodide ion is added to a second solution containing silver iodobromide host grains and to these solutions is added a third solution containing a silver ion.

An object of the present invention is to provide a silver halide photographic material which has high sensitivity and high gradation and has excellent high-speed development characteristics and a process therefor.

This object and other objects have been achieved by providing a silver halide photographic material comprising (a) a support, and (b) at least one silver halide emulsion layer containing silver halide grains on said support, wherein said silver halide grains have an internal area formed in at least one corner of the grains, said internal area having a silver iodide content higher than the silver iodide content of the circumferential area of said grains.

Another object of the invention is achieved by a silver halide photographic material as described above, wherein more than 95% of the total projected area of said silver halide grains comprises tabular silver halide grains, said tabular silver halide grains having (i) two sheets of twin planes parallel to the principal plane, and (ii) a monodisperse size distribution.

Yet another object of the invention is achieved by a process for producing a silver halide photographic material which comprises the steps of: (1) adding a first solution containing iodide ions to a second solution containing silver iodobromide host grains; (2) adding said third solution containing silver ions to the mixture from step (1) to form silver halide grains having an internal area formed in at least one corner of said grain, said internal area having a silver iodide content higher than the silver iodide content of the circumferential area of said grains.

Another object of the invention is achieved by a process for producing a silver halide photographic material which comprising the steps of; (1) adding a first solution containing iodide ions to a second solution containing silver iodobromide host grains; (2) adding said third solution containing silver ions to the mixture from step (1) to form silver halide grains wherein said silver halide grains have (a) an internal area formed in a corner, said internal area having a silver iodide content higher than the silver iodide content of circumferential area of said grains; and (b) more than 95% of the total projected area of said silver halide grains is tabular silver halide grains, said tabular silver halide grains having (i) two sheets of twin planes parallel to the principal plane, and (ii) a monodisperse size distribution.

DETAILED DESCRIPTION OF THE INVENTION

An area formed internally in the corner of a grain, that has a silver iodide content higher than that of the circumferential area of the grain as described in the present invention can be observed directly, for example, by transmission type electron microscope at low temperatures as described in J. F. Hamilton, *Photographic Science and Engineerings,* 11, 57 (1967); or in *Japanese Photography Society,* 35 (4), 213 (1972) (written by Shiosawa). These articles describe a method of observation by transmission election microscope where silver halide grains are taken out of an emulsion under safety light (so that the grains are not printed out), the grains are placed on a mesh for electron microscope observation, and observed while the sample is cooled with liquid nitrogen or liquid helium to prevent it from being damaged (e.g., printed out, etc.) by the electron beam.

The higher the accelerating voltage of an electron microscope the clearer the transmitted image obtained. The accelerating voltage is preferably 200KV for grains of up to 0.25 μm in thickness and preferably 1000 KV for grains having a thickness of not less than 0.25 μm. The higher the accelerating voltage the greater the damage done by the irradiating electron beam to the grains. This damage is minimized by cooling the sample with liquid nitrogen than liquid helium.

Photographic magnification can be varied according to grain size, but is generally 20,000 to 40,000×magnification.

The area internally formed in the corner of the grain, where the content of silver iodide is higher than that of the silver iodide in the circumferential area of the grain, according to the present invention can be clearly distinguished from corners of conventional grains by observing the image from a cooling transmission type electron microscope.

Figure 1:
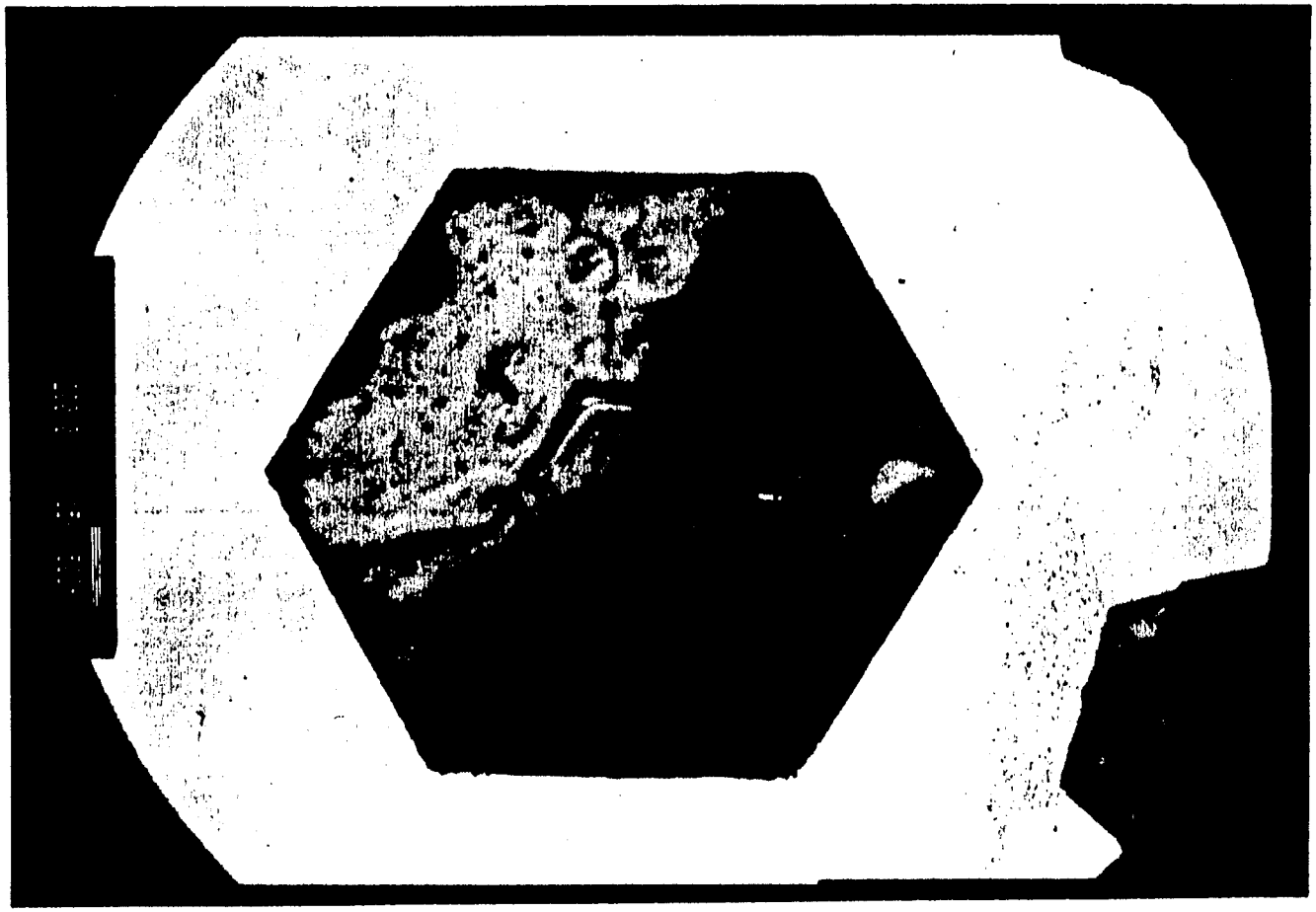
FIG. 1 is an electron microscope photograph showing the crystal structure of a silver halide grain of Emulsion-1 (22,500×magnification).

For example, in the tabular grain shown in FIG. 1, an area having a high silver iodide content exists in the inside of the outline of the hexagon. This is clearly different from grains wherein high silver iodide content areas are grown on the outsides of the corners of the grain. Further, when this area is measured with an analytical electron microscope, it can be confirmed that the content of silver iodide is higher than that of the silver iodide in the circumferential area of the grain.

The description "silver halide grains where the grains have an internal area, formed in a corner, and the silver iodide content of this area is higher than the silver iodide content of the circumferential area of the grain" as used herein refers to silver halide grains having a high silver iodide content area in which the silver iodide content is higher by at least 1 mol %, preferably 1 to 5 mol % than that of the adjoining area and can be found inside at least one corner through observation of a transmitted grain image from a cooling transmission type electron microscope or by measurement with an analytical electron microscope, these silver halide grains have a distribution such that they account for at least 60%, preferably at least 80%, more preferably at least 90% of the total grains in the emulsion. The high silver iodide content area inside the corner accounts for preferably at least 1%, more preferably at least 2%, but not more than 10% of the whole of one grain.

The term "high silver iodide content area in the corner" of the grain as used herein refers to a high silver iodide content area which exists in an area on the side nearer the apex from the surface of a sphere with a radius of ⅓ of the distance between adjoining apexes, when this sphere is drawn so that the apex of the grain is at its center. In the case of a tabular grain, this term refers to an area of high silver iodide content that exists in an area on the side nearer the apex from the surface of a cylinder formed by a circle with a radius of ⅓ of the distance between adjoining apexes on the principal plane of the tabular grains and formed by extending this circle in the direction of the thickness of the grain.

Silver halide host grains in photographic emulsions of photographic material of the present invention may contain silver chloride, silver bromide, silver chlorobromide, silver chloroiodide, silver iodobromide, silver chloroiodobromide and mixtures thereof. Among these, silver iodobromide is preferred. It is more preferred that grains contain a silver iodobromide phase having a silver iodide content of at least 5 mol %, particularly when the silver iodobromide phase accounts for at least 30%, but not more than 80% of the whole of the grain and the silver iodobromide phase is positioned outside a point which is 20% or more apart from the center on a line formed by joining the center of the grain to its outer periphery.

Figure 3:
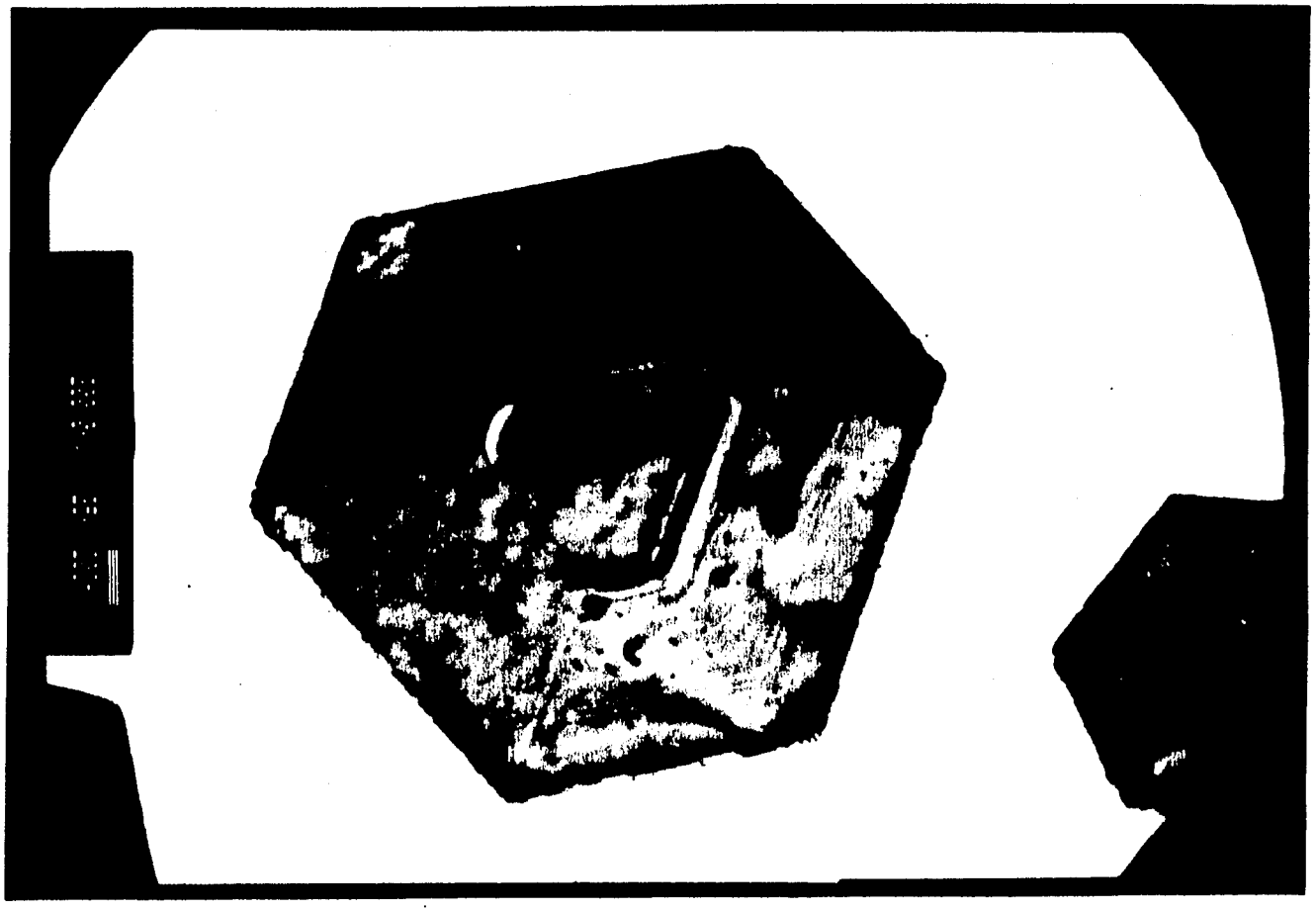
FIG. 3 is an electron microscope photograph showing the crystal structure of a silver halide grain of Emulsion-B of Example 2 (37,500×magnification).
Figure 4:
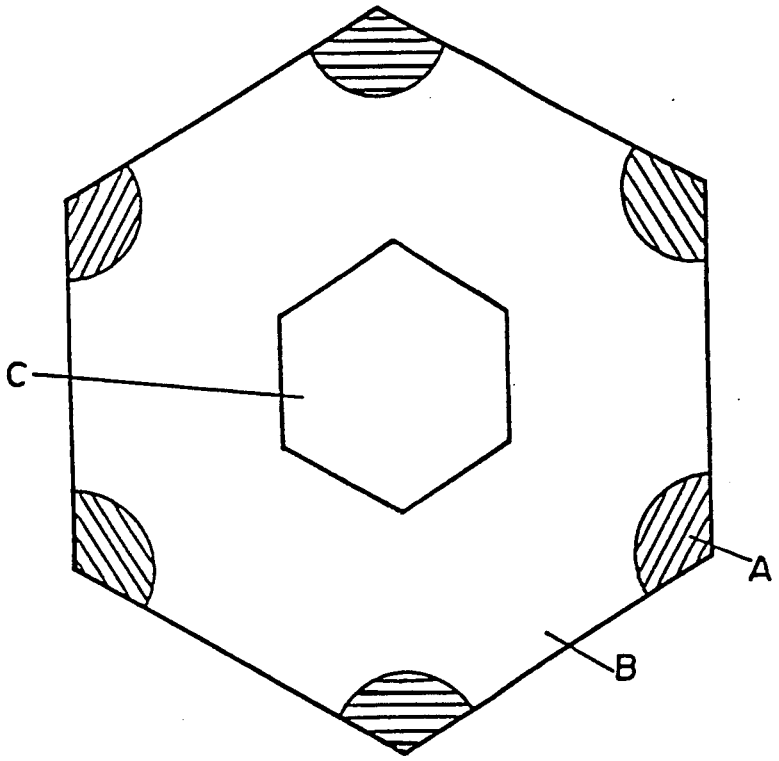
FIG. 4 shows schematically a preferred embodiment of a silver halide grain according to the present invention wherein A represents high silver iodide content area at corner, B represents silver iodobromide phases adjacent to said corner areas, and C represent a central area.

FIG. 3 shows a typical structure of the silver halide grain of the present invention. In FIG. 4, the area A is the higher silver halide content area in the corner and the area B is the silver iodobromide phase which is adjacent to A and contains at least 5 mol % of silver iodide.

The area C is the central part of the grain and has a silver iodide content of preferably 0 to 5 mol %. The proportion of the area C accounts for preferably not more than 10% of the whole of the grain.

There is no particular limitation with regard to the shape of silver halide grains in the photographic emulsions of the photographic material of the present invention. The silver halide grains of the present invention may have regular a crystal form such as a cube, an octahedron, a rhombic dodecahedron, or a tetradecahedron; irregular crystal form such as a tabular form; or a composite form of these crystal forms. Among these, tabular grains having two sheets of parallel twin planes are preferred. Particularly preferred are tabular grains having an average thickness of less than 0.3 μm, an average diameter (in terms of circle) of not less than 0.6 μm, and an average aspect ratio of not less than 5.

It is particularly preferred that silver halide grains in the emulsion layers of the present invention have such a grain size distribution such that tabular silver halide grains having two sheets of twin planes parallel to the principal plane account for more than 95% of the total projected area of the total grains and the size distribution of said tabular silver halide grains is a monodisperse system.

More specifically, the tabular grains having two sheets of parallel twin planes in the present invention are either monodisperse hexagonal tabular grains or monodisperse circular tabular grains.

In monodisperse hexagonal tabular grains, the principal plane of the tabular grain is in the form of a hexagon which has a maximum adjacent side ratio of not more than 2, the straight line part ratio of the hexagon is at least 4/5, and the aspect ratio of the grain is at least 2.0.

In monodisperse circular tabular grains, the principal plane of the tabular grain is in the form of a circle having a straight line part ratio of 4/5 to 0, and the aspect ratio of the grain is at least 2.

The term "the maximum adjacent side ratio" as used herein refers to a ratio of the maximum side length to the minimum side length on the sides of the hexagon in one hexagonal tabular grain.

The corners of the monodisperse hexagonal tabular grain of the present invention may be slightly roundish. When the corners are slightly roundish, the length of a side is represented by a distance between intersecting points when the straight line part of the side is extended and both ends of the extended line intersect with lines which are formed by extending the straight line parts of sides adjacent to the aforementioned side.

The term "straight line part ratio" as used herein refers to a ratio of the length of the straight line part of said circular flat plate to the distance between the intersecting points of the extended lines.

A feature of the tabular grain of the present invention is that the grain has two sheets of twin planes parallel to the principal plane. This can be found by observing an ultra-thin layer section (~0.1 μm thick) of the cross section of an emulsion-coated film with a transmission type electron microscope at a low temperature (liquid nitrogen temperature or liquid He temperature).

The monodisperse hexagonal tabular grains and the monodisperse circular tabular grains of the present invention are characterized by a monodisperse system. The monodisperse degree is represented by a coefficient of variation (a value obtained by dividing the standard deviation, the variation in grain sizes represented by diameters, in terms of a circle, of the project areas of the tabular grains, by the mean grain size). The monodisperse degree of the tabular grains of the present invention is not more than 30%, preferably not more than 20%, more preferably not more than 15% in terms of a coefficient of variation.

The monodisperse hexagonal tabular grains and monodisperse circular tabular grains of the present invention have an average aspect ratio of not less than 2, preferably 2.5 to 20, more preferably 4 to 16. The term "average aspect ratio" as used herein refers to the mean value of the aspect ratios of all tabular grains having a diameter of 0.2 μm or greater in the emulsion.

The silver halide emulsion of the present invention comprises at least a dispersion medium and silver halide grains where the silver halide grains have such a grain size distribution that tabular grains having two sheets of parallel twin planes account for more than 95%, preferably at least 98%, more preferably at least 99% of the total projected area of the total AgX grains.

The tabular grains of the present invention have a grain size of not less than 0.2 μm, preferably 0.2 to 5 μm.

Generally, in non-twin grains such as cubic grains, grains having a size of 0.25 to 0.75 μm in particular have a high light-scattering efficiency factor (Qsca) to visible light and this is a problem. From the standpoint of using grains having a grain size within the range described above according to the present invention and reducing Qsca, grains having a grain size of 0.25 to 0.75 μm and an aspect ratio of 3 to 20 are preferred.

These photographic emulsions can generally be prepared according to the methods described in P. Glafkides, *Chimie et Phisique Photographique* (Paul Montel 1967), G. F. Duffin, *Photographic Emulsion Chemistry* (The Focal Press 1966) and V. L. Zelikman et al, *Making and Coating Photographic Emulsion* (The Focal Press 1964). Namely, any acid process, neutral process, or ammonia process can be used. A soluble silver salt and a soluble halogen salt can be reacted in accordance with the single jet process, the double jet process or a combination of the two. A reverse mixing method wherein grains are formed in the presence of excess silver ion can also be used.

An example of a useful type of double jet process, is the controlled double jet process wherein pAg in the liquid phase in which silver halide is formed is kept constant. This process produces a silver halide emulsion where the crystal form is regular and grain size is nearly uniform.

Cadmium salt, zinc salt, lead salt, thallium salt, iridium salt complex iridium salt, rhodium salt, complex rhodium salt, iron salt, or complex iron salt may be allowed to coexist during the course of the formation of silver halide grains or physical ripening. If desired, grains may be formed in the presence of a solvent of silver halide, such as ammonia or thioether compounds.

Subsequently, the following operation is carried out to provide the high silver halide content area inside the corners of the thus-obtained silver halide host grains. Namely, a solution containing an iodide ion is added to a solution containing the silver halide host grains. After the lapse of at least one second, more preferably at least one minute, the addition of a solution containing a silver ion is commenced. The time taken for the addition of the iodide ion solution from beginning to end may overlap with the time taken for the addition of the silver ion solution from beginning to end or may be different from the time taken for the addition of the silver ion solution.

However, it is preferred that the addition of the iodide ion solution be completed prior to the addition of the silver ion solution.

After the formation of grains is completed (that is after the formation of precipitate or after physical ripening), soluble salts are generally removed from the emulsion (desalting stage). Examples of desalting methods include the water washing method with noodle wherein gelatin is caused to gel; and precipitation methods (flocculation) using inorganic salts comprising a polyvalent anion (e.g., sodium sulfate), anionic surfactants, anionic polymers (e.g., polystyrenesulfonic acid), or gelatin derivatives (e.g., aliphatic acylated gelatin, aromatic acylated gelatin, aromatic carbamoylated gelatin).

The silver halide emulsion may be used without carrying out chemical sensitization. Namely, non-after-ripened emulsion as such can be used, but the emulsion is usually chemical-sensitized. Chemical sensitization can be carried out according to the methods described in *Die Grundlagen der Photographisches Prozesse mit Silberhalogeniden* (Akademische Verlagsgesellshaft 1968) edited by H. Friezer and books written by Glafkides or Zelikman.

Examples of chemical sensitization methods include the sulfur sensitization method using sulfur-containing compounds capable of reacting with silver ion or active gelatin; the reduction sensitization method using reducible substances; and the noble metal sensitization method using gold or other noble metal compounds. These methods may be used either alone or in combination.

Examples of sulfur sensitizing agents include thiosulfates and thioureas as is disclosed in U.S. Pat. Nos. 1,574,944 and 2,410,689 thiazoles and rhodanines as is disclosed in U.S. Pat. No. 2,278,947. Other examples of these compounds are described in U.S. Pat. Nos. 2,728,668 and 3,656,955.

Examples of reduction sensitizing agents include tin(II) salts, amines, hydrazine derivatives, formamidinesulfinic acid and silane compounds.

For noble metal sensitization, complex salts of Group VIII metals such as platinum, iridium and palladium of the Periodic Table in addition to gold complex salts can be used.

Sulfur sensitization and a combination of sulfur sensitization with gold sensitization are particularly preferred in the present invention.

Any of the spectral sensitizing dyes can be used in the present invention. Examples of spectral sensitizing dyes include cyanine dyes, merocyanine dyes, hemicyanine dyes, rhodacyanine dyes, oxonol dyes, hemioxonol dyes, methine dyes and styryl dyes. Among them, cyanine dyes are preferred. Cyanine dyes represented by the following formula (I) are effective.

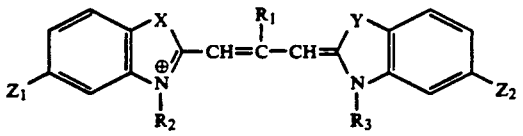

In formula (I), $R_1$ represents an alkyl group; $R_2$ and $R_3$ may be the same or different groups and each represents an alkyl group, a carboxylalkyl group or a sulfoalkyl group; X and Y may be the same or different groups and each represents oxygen, sulfur or selenium; and $Z_1$ and $Z_2$ may be the same or different groups each represents hydrogen atom, halogen, hydroxyl group, an alkoxy group, carboxyl group, a carboxylalkyl group or an acetylamino group. Preferably, each of the substituents represented by $R_1$, $R_2$, $R_3$, $Z_1$ and $Z_2$ has not more than 6 carbon atoms. The dyes represented by the following formulae are particularly preferred.

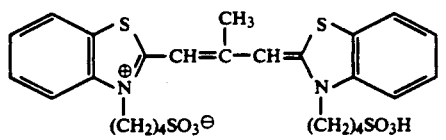

I-1

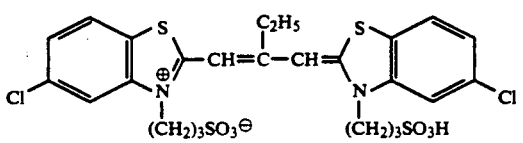

I-2

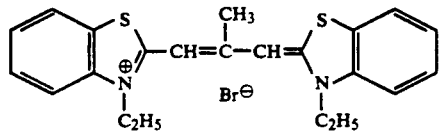

I-3

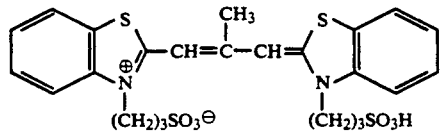

I-4

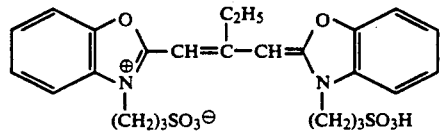

I-5

The amounts of the spectral sensitizing agents to be added (before or during chemical sensitization or before solidification by cooling after the completion of chemical sensitization) vary depending on the types of additives and the amount of silver halide present. Preferably, however, 0.01 to 10 mmol, more preferably 0.05 to 5 mmol, particularly preferably 0.1 to 1 mmol per mol of silver halide are added.

The addition of a spectral sensitizing dye may be made before or during chemical ripening, at the time of the beginning of chemical ripening, or before the solidification of the emulsion by cooling after the completion of chemical ripening. Specifically, the spectral sensitizing dye may be added before or during the addition of the silver salt solution in the course of the formation of silver halide emulsion grains; before or during chemical ripening after the addition of the silver salt solution; at the time of the completion of chemical ripening; or before the solidification of the emulsion by cooling after the completion of chemical ripening. It is particularly preferred that the spectral sensitizing dye be added before the beginning of chemical ripening.

When the spectral sensitizing dye is added before the solidification of the emulsion by cooling after the completion of chemical ripening, the temperature of the emulsion may be lower or higher than the temperature of chemical ripening. Alternatively, the addition may be made during the change of temperature.

Typical examples of supports which can be used for the photographic materials of the present invention include cellulose nitrate film, cellulose acetate film, polyvinyl acetal film, polystyrene film, polyethylene terephthalate film, other polyester films, glass, paper, wood, and metals.

There is no particular limitation with regard to the coating weight of the silver halide emulsions of the present invention. However, the coating weight is preferably 0.5 to 10 g/m$^2$, particularly preferably 1 to 7 g/m$^2$ (in terms of silver) per side.

There is no particular limitation with regard to the thickness of the photographic material of the present invention. However, the thickness is preferably 0.5 to 15 μm, more preferably 1 to 10 μm.

The silver halide photographic material of the present invention comprises the emulsion layer comprising silver halide as described above and optionally hydrophilic colloid layers such as other silver halide emulsion layers, non-sensitive layers (e.g., a surface protective layer or an interlayer.

The silver halide emulsion layers and other hydrophilic colloid layers of the present invention are illustrated below.

Gelatin can be advantageously used as a binder or protective colloid for use in the emulsion layers or interlayers of the photographic material of the present invention. However, other hydrophilic colloids can also be used.

Examples of usable hydrophilic colloids include protein (such as gelatin derivatives, graft polymers of gelatin with other high-molecular materials, albumin and casein); cellulose derivatives (such as hydroxyethyl cellulose, carboxymethyl cellulose and cellulose sulfate); saccharide derivatives (such as agar-agar, sodium alginate and starch derivatives); and various synthetic hydrophilic high-molecular materials including homopolymers (such as polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole); and copolymers of the monomers of these homopolymers.

Examples of gelatin include lime-processed gelatin, acid-processed gelatin and enzyme-processed gelatin. Gelatin containing high-molecular components as described in JP-A-62-87952 is preferred.

Alkyl acrylate latexes described in U.S. Pat. Nos. 3,411,911 and 3,411,912 and JP-B-45-5331 (the term "JP-B" as used herein means an "examined Japanese patent publication") can be incorporated in the photographic layers of the photographic material of the present invention.

The emulsion layers and other hydrophilic colloid layers of the photographic material of the present invention may contain polyoxyethylene compounds for the purpose of obtaining a sensitization effect. Polyoxyethylene compounds having at least two oxyethylene groups, preferably 2 to 100 oxyethylene groups are preferred.

Polyoxyethylene compounds are preferably added to the sensitive emulsion layers of the photographic material. However, these compounds may be added to other non-sensitive layers.

Polyoxyethylene compounds can be applied to the layers of the photographic material by adding them to a coating solution for forming the layers or dissolving them in water, an organic solvent such as methanol, ethanol or acetone, or a mixture of water with said organic solvent, and adding the resulting solution to the coating solution. Subsequently, the coating solution is coated or sprayed on the surface of the support and dried. Alternatively, the support is immersed in the coating solution and then dried.

When the compounds are to be added to the emulsions, they may be added during the course of the manufacturing process of the emulsions (e.g., during chemical ripening) or may be added to the emulsions after the completion of the manufacturing process of the emulsion. It is particularly preferred that the addition be made just before coating after the preparation on the emulsion.

Polyoxyethylene compounds may be incorporated in two or more layers.

The photographic material of the present invention may contain various compounds such as antifogging agents or stabilizers. Examples of such compounds which are known as anti-fogging agents or stabilizers include azoles (such as benzthiazolium salts, nitroindazoles, triazoles, benztriazoles and benzimidazoles, particularly nitro- or halogen-substituted derivatives); heterocyclic mercapto compounds (such as mercaptothiazoles, mercaptobenzthiazoles, mercaptobenzimidazoles, mercaptothiadiazoles, mercaptotetrazoles, particularly 1-phenyl-mercaptotetrazole, and mercaptopyridine); heterocyclic mercapto compounds having a water-soluble group (such as a carboxyl group or a sulfo group); thio-keto compounds (such as tetraazaindene compounds, particularly 4-hydroxy-substituted-1,3,3*a*,7-tetraazaindene); benzenethiosulfonic acids; and benzenesulfinic acids.

More specifically, examples of these compounds and methods for using them are described in U.S. Pat. Nos. 3,954,474, 3,982,947 and 4,021,248 and JP-B-52-28660.

The photographic layers and other hydrophilic colloid layers of the present invention may contain inorganic or organic hardening agents. Examples of such hardening agents include chromium salts (e.g., chromium alum, chromium acetate); aldehydes (e.g., formaldehyde, glyoxal, succinaldehyde, glutaraldehyde); N-methylol compounds (e.g., dimethylol urea, methylol dimethylhydantoin); dioxane derivatives (e.g., 2,3-dihydroxy-dioxane); active vinyl compounds (e.g., divinyl sulfone, methylenebismaleimide, 1,3,5-triacryloylhexahydro-s-triazine, 5-acetyl-1,3-diacryloylhexahydro-s-triazine, 1,3,5-trivinylsulfonylhexahydro-s-triazinebis(-vinylsulfonylmethyl) ether, 1,3-bis(vinylsulfonyl)-2-propanol, bis(u-vinylsulfonylacetamido)ethane, bis-vinylsulfonylmethane); active halogen compounds (e.g., 2,4-di-chloro-6-hydroxy-s-triazine); mucohalogenic acids (e.g., mucochloric acid, mucophenoxychloric acid), N-carbamoylpyridinium salts (e.g., 1-morpholinocarbonyl-3-pyridinio)methanesulfonate); and haloamidinium salts (e.g., (1-(1-chloro-1-pyridinomethylene)pyrrolidinium 2-naphthalenesulfonate). These compounds may be used either alone or in combination.

The emulsion layers or other hydrophilic colloid layers of the photographic material of the present invention may contain various surfactants as coating aids; for the purpose of imparting antistatic properties, improving slipperiness, improving emulsifying dispersion, or improving photographic characteristics (e.g., development acceleration, high contrast, sensitization); or preventing sticking. Examples of usable surfactants include, nonionic surfactants such as saponin (steroid); alkylene oxide derivatives (e.g., polyethylene glycol, polyethylene glycol/polypropylene glycol condensate, polyethylene glycol alkyl ethers, polyethylene glycol alkylaryl ethers, polyethylene glycol esters, polyethylene glycol sorbitan esters, polyalkylene glycol alkylamines or amides, and polyethylene oxide adducts of silicones); glycidol derivatives (e.g., polyglycerides of alkenylsuccinic acids, and alkylphenol polyglycerides); fatty acid esters of polyhydric alcohols; and alkyl esters of saccharose; (2) anionic surfactants having an acid group (e.g., carboxyl group, sulfo group, phospho group, sulfuric ester group, phosphoric ester group) such as alkylcarboxylates, alkylsulfonates, alkylbenzenesulfonates, alkylnaphthalenesulfonates, alkylsulfuric esters, alkylphosphoric esters, N-acyl-N-alkyltaurines, sulfosuccinic esters, sulfoalkylpolyoxyethylene alkylphenyl ethers and polyoxyethylene alkylphosphoric esters; (3) amphoteric surfactants such as amino acids, aminoalkylsulfonic acids, aminoalkylsulfuric or phosphoric esters, alkylbetaines and amine oxides; and (4) cationic surfactants such as alkylamine salts, aliphatic or aromatic quaternary ammonium salts, heterocyclic quaternary ammonium salts such as pyridinium and imidazolium and aliphatic or heterocyclic phosphonium or sulfonium salts.

Fluorine-containing surfactants described in JP-A-60-80849 are useful for the purpose of controlling antistatic properties.

The photographic emulsions of the present invention may be spectrally-sensitized with methine dyes, etc. before or during chemical ripening or before the solidification of the emulsion by cooling (after the completion of chemical ripening as described above) and before the emulsion is applied to the support. Examples of spectral sensitizing dyes which can be used in the present invention include cyanine dyes, merocyanine dyes, complex merocyanine dyes, holopolar cyanine dyes, hemicyanine dyes, styryl dyes and hemioxonol dyes. Among them, particularly useful dyes are cyanine dyes, merocyanine dyes and complex merocyanine dyes. Any of the nuclei generally used as basic heterocyclic nuclei for cyanine dyes can be applied to these dyes. Examples of the nuclei which can be applied to these dyes include pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei; nuclei formed by fusing an alicyclic hydrocarbon ring to these nuclei; and nuclei formed by fusing an aromatic hydrocarbon ring to these nuclei such as indolenine nuclei, benzindolenine nuclei, indole nuclei, benzoxazole nuclei, naphthoxazole nuclei, benzthiazole nuclei, naphthothiazole nuclei, benzselenazole nuclei, benzimidazole nuclei, and quinoline nuclei. These nuclei may have one or more substituent groups on a carbon atom.

5-membered or 6-membered heterocyclic nuclei such as pyrazoline-5-one nuclei, thiohydantoin nuclei, 2-thiooxazolidine-2,4-dione nuclei, rhodanine nuclei and thiobarbituric acid nuclei as nuclei having a ketomethylene nuclei can be applied to merocyanine dyes or complex merocyanine dyes.

In addition to the sensitizing dyes, the emulsions may contain a dye which itself does not have spectral sensitization activity or a substance which does substantially not absorb visible light, but exhibits supersensitization activity. For example, the emulsions may contain nitrogen-containing heterocyclic group-substituted aminostilbene compounds (e.g., described in U.S. Pat. Nos. 2,933,390 and 3,635,721), aromatic organic acid/formaldehyde condensates (e.g., described in U.S. Pat. No. 3,743,510), and azaindene compounds. Combinations described in U.S. Pat. Nos. 3,615,613, 3,615,641, 3,617,295 and 3,635,721 are particularly useful.

The photographic emulsion layers of the photographic material of the present invention may contain thioether compounds, thiomorpholine compounds, quaternary ammonium salt compounds, urethane derivatives, urea derivatives, imidazole derivatives and 3-pyrazolidone compounds for the purpose of increasing sensitivity and contrast or accelerating development. For example, those described in U.S. Pat. Nos. 2,400,532, 2,423,549, 2,716,062, 3,617,280, 3,772,021 and 3,808,003 and U.K. Patent 1,488,991 can be used.

The photographic emulsion layers and other hydrophilic colloid layers of the photographic material of the present invention may contain the dispersion of a water-soluble or difficultly water-soluble synthetic polymer to improve dimensional stability. For example, polymers of an alkyl (meth)acrylate, an alkoxyalkyl (meth)acrylate, glycidyl (meth)acrylate, (meth) acrylamide, a vinyl ester (e.g., vinyl acetate) , acrylonitrile, an olefin, or styrene alone or a combination thereof can be used. Further, polymers of the above-described monomers with acrylic acid, methacrylic acid, an $\alpha,\beta$-unsaturated dicarboxylic acid, a hydroxyalkyl acrylate, a sulfoalkyl (meth)acrylate, or styrenesulfonic acid can be used.

The photographic material of the present invention may contain dye image forming couplers, that is, compounds which form colors through oxidative coupling with aromatic primary amine developing agents (e.g., phenylenediamine derivatives, aminophenol derivatives) in color development processing.

Non-diffusing couplers having a hydrophobic group (a ballast group) or polymer couplers are preferred. Couplers may be any type that are tetraequivalent or diequivalent with respect to the silver ion. Colored couplers having a color correction effect or couplers releasing a development restrainer (DIR couplers) may be incorporated.

Examples of magenta couplers include 5-pyrazolone couplers, pyrazolobenzimidazole couplers, cyanoacetylcoumarone couplers, and open chain acylacetonitrile couplers. Examples of yellow couplers include acylacetamide couplers (e.g., benzoylacetanilides, pivaloylacetanilides). Examples of cyan couplers include naphthol couplers and phenol couplers.

The emulsion layers and other hydrophilic colloid layers of the photographic material of the present invention may contain various compounds as a preservative. Examples of such compounds include phenols such as phenol, cresol, 4-chloro-3,5-dimethylphenol, methyl p-hydroxybenzoate, phenoxyethanol, and 3-benzisothiazolidone. These compounds may be used either alone or in combination.

There are no particular limitations with regard to the structure of the photographic material of the present invention and other conditions thereof. The photographic material of the present invention can be prepared by referring to the disclosures of *Research Disclosure*, Vol. 176, RD-17643 (December 1978)and ibid., Vol. 187, RD-18716 (November 1979).

The silver halide photographic material of the present invention can be used as X-ray photographic material, lith photographic material, black-and-white photographic material, color negative photographic material, reversal color photographic material, and color photographic paper. Among these, the photographic material of the present invention is particularly suitable for use as negative photographic material.

The photographic material of the present invention can be processed by any conventional methods. Conventional processing solutions can be used. Pressing temperature is generally in the range of 18° to 50° C. However, temperatures lower than 18° C. or higher than 50° C. can be used.

The effect of the present invention is particularly remarkable on black-and-white photographic material. Black-and-white developing solutions may contain conventional developing agents such as dihydroxybenzenes (e.g., hydroquinone), 3-pyrazolidones (e.g., 1-phenyl-3-pyrazolidone), and aminophenols (e.g., N-methyl-p-aminophenol) singly or in combination.

The present invention is illustrated in greater detail by reference to the following examples which, are not to be construed as limiting the invention in any way. In these examples, all parts percentages, and ratios are by weight unless otherwise indicated.

EXAMPLE 1

(1) Preparation of tabular silver halide emulsion (Emulsion-1)

The following kinds of Solutions were prepared to prepare a tabular silver halide emulsion.

| | | |
|---|---|---|
| A: | KBr | 5.8 g |
| | Ossein gelatin | 7.7 g |
| | $H_2O$ | 950 cc |
| B: | Ossein gelatin | 22 g |
| | $H_2O$ | 198 cc |
| C: | $AgNO_3$ | 0.34 g |
| | Add $H_2O$ | to make 8.5 cc |
| D: | $AgNO_3$ | 6.3 g |
| | Add $H_2O$ | to make 156.8 cc |
| E: | $AgNO_3$ | 144 g |
| | Add $H_2O$ | to make 576 cc |
| F: | $AgNO_3$ | 25.4 g |
| | Add $H_2O$ | to make 212 cc |
| G: | KBr | 0.47 g |
| | Add $H_2O$ | to make 3 cc |
| H: | KBr | 131.6 g |
| | KI | 9.7 g |
| | Add $H_2O$ | to make 800 cc |
| I: | KI | 4.4 g |
| | Add $H_2O$ | to make 80 cc |

Stirred into Solution A at 30° C., were Solutions C and G by the double jet process. Solution B was then added and the temperature of the mixture raised to 75° C.

Thereafter, Solution D was added to the mixture over a period of 28 minutes. Solutions E and H were then added over a period of 60 minutes at such a rate that the addition rate at the time of commencement was 0.96 cc/min. This addition rate was gradually increased. Solution I was added over a period cf 20 minutes. Subsequently, Solution F was added over a period of 53 minutes. After the completion of these additions, Emulsion was desalted by convention method to obtain Emulsion-1.

FIG. 1 is a photograph of the silver halide grain of Emulsion-1, taken through a JEM-2000 FX transmission type electron microscope manufactured by Nippon Denshi KK. Accelerating voltage was 200KV and the sample was cooled to −130° C. with liquid nitrogen. An area having a contrast clearly different from that of circumferential area was found inside the corner area of grain. Further, the average silver iodide content of grain was measured by an analytical electron microscope (EM-ASID 20 manufactured by Nippon Denshi KK, PV-9800 manufactured by EDAX). The following results were obtained.

| | |
|---|---|
| Corner area | 9.8% |
| Area adjacent to the inside of corner | 6.7% |
| Edge area between two corners | 7.1% |

The silver halide grains of Emulsion-1 had an average thickness of 0.14 μm, an average diameter (in terms of a circle) of 2.33 μm and an average aspect ratio of 17.5.

Chemical sensitization of Emulsion 1 was carried out in the following manner. During chemical sensitization, the pH of Emulsion 1 was 6.40, pAg was 8.70, and the temperature was 54° C.

Emulsion-1*a* (invention)

After a methanol solution of sensitizing dye I-1 in an amount of $8.1\times10^{-4}$ mol/mol of $AgNO_3$ was added to Emulsion-1, chemical sensitization was enhanced with gold-sulfur sensitization using chloroauric acid and sodium thiosulfate.

Emulsion-1*b* (invention)

After a methanol solution of sensitizing dye I-2 in an amount of $8.1\times10^{-4}$ mol/mol of AgNO3 was added to the emulsion-1, chemical sensitization was enhanced with gold-sulfur sensitization using chloroauric acid and sodium thiosulfate.

Emulsion-1*c* (invention)

After a methanol solution of sensitizing dye I-3 in an amount of $4.9\times10^{-4}$ mol/mol of AgNO3 was added to the emulsion-1, chemical sensitization was enhanced with gold-sulfur sensitization method using chloroauric acid and sodium thiosulfate.

(2) Preparation of a Tabular Silver Halide Emulsion (Emulsion-2)

In a similar manner to that of Emulsion-1, Emulsion-2 was prepared. In the preparation of Emulsion-2, the addition of Solution F was commenced after the lapse of 10 minutes from the commencement of the addition of Solution I. After completion of the addition of Solution F, the emulsion was desalted by conventional method. The silver halide grains of Emulsion-2 had an average thickness of 0.13 μm, an average diameter (in terms of a circle) of 2.50 μm and an average aspect ratio of 19.9.

Chemical sensitization was then carried out in the following manner. During chemical sensitization, the pH of the emulsion was 6.40, pAg was 8.70, and the temperature was 54° C.

Emulsion-2*a* (invention)

In the same manner as in Emulsion-1*a*.

Emulsion-2*b* (invention)

In the same manner as in Emulsion-1*b*.

Emulsion-2*c* (invention)

In the same manner as in Emulsion-1*c*.

(3) Preparation of Tabular Silver Halide Emulsion (Emulsion-3)

In a similar manner to that of Emulsion-1, Emulsion-3 was prepared. In the preparation of Emulsion-3, the addition of Solutions F and I was simultaneously commenced. After the completion of the addition, the Emulsion was desalted by conventional method. The silver halide grains of Emulsion-3 had an average thickness of 0.14 μm, an average diameter (in terms of a circle) of 2.44 μm, and an average aspect ratio of 18.3.

Chemical sensitization was then carried out in the following manner. During chemical sensitization, the pH of the Emulsion was 6.40, pAg was 8.70, and the temperature was 54° C.

Emulsion-3*a* (Comparative Example)

In the same manner as in Emulsion-1*a*.

Emulsion-3*b* (Comparative Example)

In the same manner as in Emulsion-1*b*.

Emulsion-3*c* (Comparative Example)

In the same manner as in Emulsion-1*c*.

(4) Preparation of a Tabular Silver Halide Emulsion (Emulsion-4)

In a similar manner to that of Emulsion-1, Emulsion-4 was prepared. In the preparation of Emulsion-4, the addition of Solutions F was commenced 10 minutes before the addition of Solution I was commenced. After the completion of the addition, Emulsion was desalted by conventional method.

Figure 2:
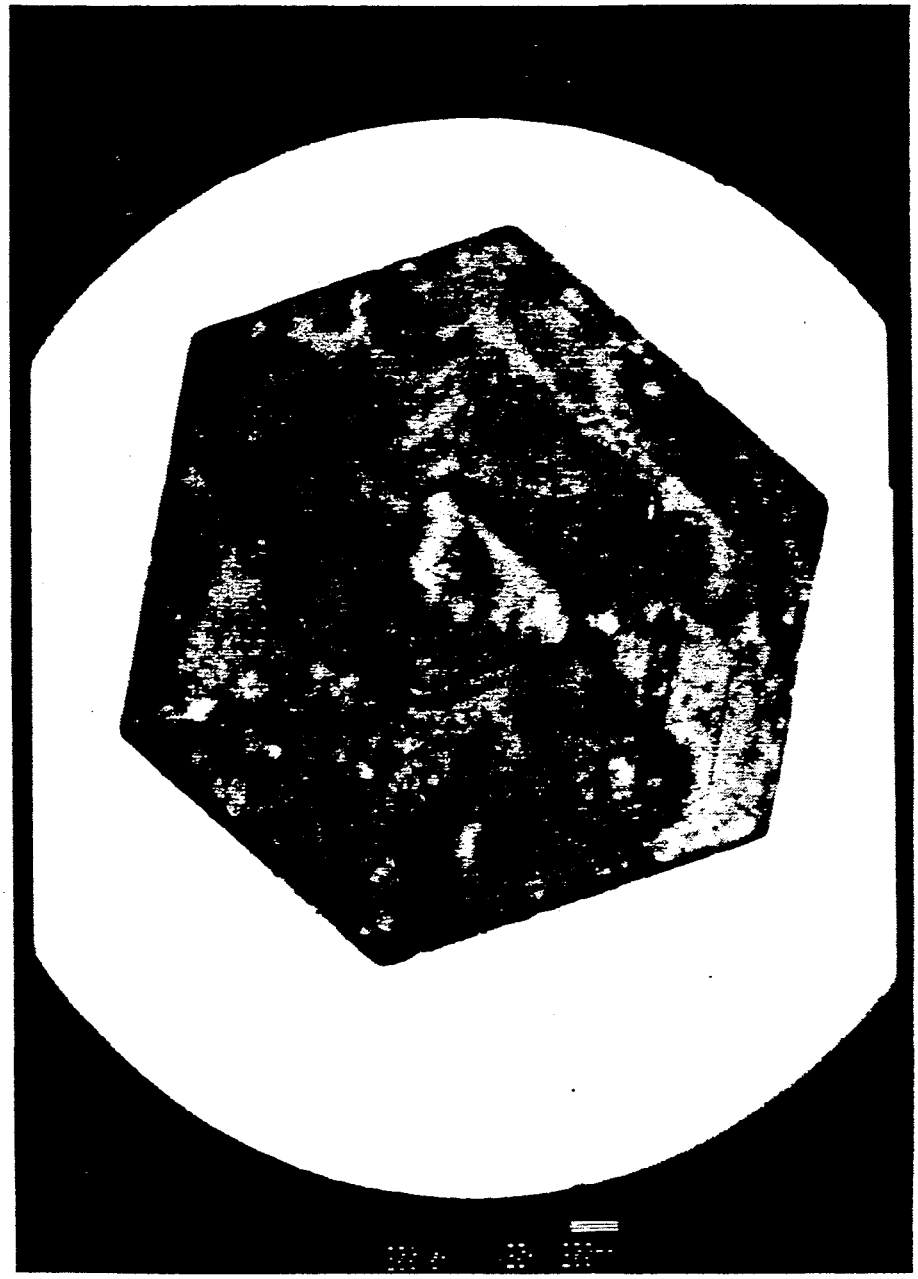
FIG. 2 is an electron microscope photograph showing the crystal structure of a silver halide grain of Emulsion-4 (30,000×magnification).

FIG. 2 is a photograph of a silver halide grain of Emulsion-4, taken through a transmission type electron microscope. Unlike the Emulsion-1, an area in the corner part of grain different in contrast from circumferential area was not found.

The silver halide grains of the Emulsion-4 had an average thickness of 0.14 μm, an average diameter (in terms of a circle) of 2.43 μm, and an average aspect ratio of 18.5.

Chemical sensitization was then carried out in the following manner. During chemical sensitization, the pH of the emulsion was 6.40, pAg was 8.70 and, the temperature was 54° C.

Emulsion-4*a* (Comparative Example)

In the same manner as in Emulsion-1*a*.

Emulsion-4*b* (Comparative Example)

In the same manner as in Emulsion-1*b*.

Emulsion-4*c* (Comparative Example)

In the same manner as in Emulsion-1*c*.

(5) Preparation of Samples

The following layers having the following formulations in order were provided on the surface of a cellulose triacetate support to prepare each of samples 1 to 12 given in Table 1.

| | |
|---|---|
| Emulsion Layer: | |
| Emulsion (indicated in Table 1) (in terms of silver) | 5.0 g/m$^2$ |
| Binder: gelatin | 7.0 g/m$^2$ |
| Additives: $C_{18}H_{35}O(CH_2CH_2O)_{25}H$ | 5.8 g/g.Ag |
| trimethylol propane | 400 g/m$^2$ |
| Coating aid: polypotassium p-styrenesulfonate | 0.7 g/m$^2$ |
| Surface Protective Layer: | |
| Binder: gelatin | 0.8 g/m$^2$ |
| Coating aid: | 12 mg/m$^2$ |

-continued

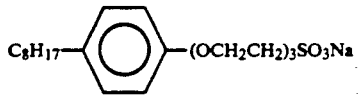

| | |
|---|---|
| Antistatic agent: $C_8F_{17}SO_2N(C_3H_7)CH_2COOK$ | 2 mg/m$^2$ |
| Hardening agent: 1,2-bis(vinylsulfonylacetamide)ethane | 2.3 × 10$^{-4}$ mol/m$^2$ |
| Matting agent: fine particles of polymethyl methacrylate (average particle 3 μm) | 0.13 mg/m$^2$ |

(6) Comparison of Performance

These Samples were stored at 25° C and 65% RH for 7 days after coating. Each sample was exposed to a tungsten light at 4000 lx through an optical wedge for 1/100 seconds. The exposed sample was processed with a developing solution having the following formulation for 4 minutes and 7 minutes, fixed with a fixing solution having the following formulation, rinsed for 10 minutes and dried. The reciprocal of exposure amount giving a density higher by 0.1 than fogged value is referred to herein as "sensitivity". The sensitivity of each sample is represented by relative photographic sensitivity with the sensitivity of Sample No. 4 processed for 4 minutes referred to as 100.

The results are shown in Table 1.

| | |
|---|---|
| Developing Solution: | |
| p-Methylaminophenol sulfate | 2 g |
| Sodium sulfite | 10 g |
| Hydroquinone | 5 g |
| Borax (decahydrate) | 2 g |
| Add water | to make 1 liter |
| Fixing Solution: | |
| Ammonium thiosulfate | 200.0 g |
| Sodium sulfite (anhydrous) | 20.0 g |
| Boric acid | 8.0 g |
| Disodium ethylenediaminetetraacetate | 0.1 g |
| Aluminum sulfate | 15.0 g |
| Sulfuric acid | 2.0 g |
| Glacial acetic acid | 22.0 g |
| Add water | to make 1 liter |
| pH was adjusted to | 4.2 |

(7) Results

It is apparent from Table 1 that the photographic materials of the present invention have high sensitivity even when no sensitizing dye is used and, that this sensitivity is higher when development time is prolonged.

TABLE 1

| | | Relative Sensitivity | |
|---|---|---|---|
| Sample No. | Emulsion | 4 min. | 7 min. |
| 1 (Invention) | 1a | 130 | 415 |
| 2 (Invention) | 2a | 165 | 390 |
| 3 (Comp. Ex.) | 3a | 140 | 355 |
| 4 (Comp. Ex.) | 4a | 100 | 280 |
| 5 (Invention) | 1b | 330 | 535 |
| 6 (Invention) | 2b | 300 | 525 |
| 7 (Comp. Ex.) | 3b | 280 | 435 |
| 8 (Comp. Ex.) | 4b | 245 | 345 |
| 9 (Invention) | 1c | 250 | 430 |
| 10 (Invention) | 2c | 235 | 415 |
| 11 (Comp. Ex.) | 3c | 205 | 325 |
| 12 (Comp. Ex.) | 4c | 150 | 235 |

EXAMPLE 2

(a) Monodisperse Tabular Grains 27.5 cc of an aqueous $AgNO_3$ solution (32 g of $AgNO_3$, 0.7 g of gelatin having an average molecular weight ($\overline{M}$) of 20,000, and 1.4 ml of $HNO_3$(IN) in 100 ml of the aqueous $AgNO_3$ solution) and 27.5 cc of an aqueous KBr solution (23.2 g of KBr and 0.7 g of gelatin having an $\overline{M}$ of 20,000 in 100 ml of the aqueous KBr solution) were simultaneously added at a rate of 25 cc/min to 1 liter of an aqueous solution containing 4.5 g of KBr and 7 g of gelatin having an $\overline{M}$ of 20,000 with stirring using the double jet process. The temperature was 30° C. 350 ml of the resulting emulsion was used as a seed crystal, and 650 ml of an aqueous gelatin solution (containing 20 g of gelatin and 1.2 g of KBr) was added thereto. The temperature of the emulsion was raised to 75° C and the emulsion was ripened for 40 minutes. An aqueous $AgNO_3$ solution (containing 1.7 g of $AgNO_3$) was added over a period of 90 seconds. Subsequently, 6.2 ml of an aqueous solution of 50 wt % $NH_3NO_3$ and 6.2 ml of an aqueous solution of 25 wt % $NH_3$ were added, and the emulsion was ripened for 40 minutes. The pH of the emulsion was adjusted to 7.0 with HN03 (3N) and 1 g of KBr was added. An aqueous $AgNO_3$ solution (10 g of $AgNO_3$ being contained in 100 ml of said aqueous $AgNO_3$ solution) and an aqueous solution of a mixture of KBr and KI were added at a rate of 8 ml/min for the first 10 minutes and then at a rate of 15 ml/min for 20 minutes by controlled double jet process at a silver potential of −20 mV. The amount of KI added was 3.6 g. The emulsion was washed with water and re-dispersed (Emulsion-A).

The reprica image of the resulting emulsion grains was observed by TEM (3280×magnification). The characteristics of the grains in the emulsion were as follows.

The ratio of the projected area of grains 99.7%

| | |
|---|---|
| The mean grain size of grains | 1.1 μm |
| The average thickness of grains | 0.16 μm |
| The average aspect ratio of grains | 6.9 |
| The coefficient of variation of grains | 10.1% |

(b) Monodisperse Hexagonal Tabular Grains (Emulsion-B)

Emulsion-B was formed in the same way as in the formation of the grains of Emulsion A above, except that the addition of the aqueous KBr solution and the aqueous $AgNO_3$ solution was interrupted when the time remaining in the addition period was 4 minutes, and an aqueous solution of 1.1 g of KI and 25 cc of $H_2O$ was added before adding the remainder of the aqueous $AgNO_3$ solution.

The characteristics of the grains for Emulsion E were as follows.

The ratio of the projected area of grains 99.8%

| | |
|---|---|
| The mean grain size of grains | 1.1 μm |
| The average thickness of grains | 0.15 μm |
| The average aspect ratio of grains | 7.3 |
| The coefficient of variation of grains | 10.6% |

FIG. 3 is a photograph of the silver halide grain of Emulsion-B, taken through a JEM-2000 FX transmission type electron microscope manufactured by Nippon Denshi KK. Accelerating voltage was 200 kV and the sample was cooled to −130° C. with liquid nitrogen. An area having a contrast clearly different from that of circumferential area was found inside the corner area of the grain. Further, the average silver iodide content of grain was measured by an analytical electron microscope (EM-ASID 20 manufactured Nippon Denshi KK, PV-9800 manufactured by EDAX). The following results were obtained.

| | |
|---|---|
| Corner area | 10.1% |
| Area adjacent to the inside of corner | 6.8% |
| Edge area between two corners | 7.1% |

A methanol solution of sensitizing dye I-3 in $4.9\times10^{-4}$ mol/mol of $AgNO_3$ was added to Emulsion A and Emulsion B. Each of the Emulsions was chemically sensitized by gold-sulfur sensitization using chloroauric acid and sodium thiosulfate.

Preparation of Samples and Comparison of Performance

The preparation of samples and the comparison of performance were carried out in the same way as in Example 1.

Results

The results are shown in Table 2.

TABLE 2

| Sample No. | Emulsion | Relative Sensitivity 4 min. | Relative Sensitivity 7 min. |
|---|---|---|---|
| 1 (Emulsion A) | Emulsion A | 100 | 260 |
| 2 (Emulsion B) | Emulsion B | 170 | 390 |

It is apparent from Table 2 that Sample 2 using Emulsion B composed of monodisperse hexagonal tabular grains has high sensitivity, particularly when processed for 7 minutes.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising:
(a) a support, and
(b) at least one silver halide emulsion layer containing silver halide grains on said support, said silver halide grains consisting essentially of:
(i) a central part,
(ii) a circumferential region surrounding said central part; and
(iii) an internal region formed in one or more corners in the circumferential region, said internal region having a silver iodide content higher than a silver iodide content of said circumferential region.

2. A silver halide photographic material as claimed in claim 1, wherein said internal region has a silver iodide content at least 1 mol % higher than that of said circumferential region.

3. A silver halide photographic material as claimed in claim 1, wherein the silver halide grains have a distribution such that they account for at least 60% of the total grains in the emulsion.

4. A silver halide photographic material as claimed in claim 1, wherein said internal region exists in an area on the side nearer the apex from the surface of a sphere with a radius of ⅓ of the distance between the adjoining apexes, when the sphere is drawn so that the apex of the grain is at its center.

5. A silver halide photographic material as claimed in claim 1, wherein said silver halide grains contain a silver iodobromide phase having a silver iodide content of at least 5 mol %, where said silver iodobromide phase accounts for from 30% to 80% of the whole grain, and is positioned in a region that is at a distance of more than 20% of the distance from the center of the grain, wherein 100% of said distance is defined by the length of a line drawn from the center of the grain to its outer periphery.

6. A silver halide photographic material as claimed in claim 1, wherein said circumferential region is a silver iodobromide phase containing at least 5 mol % of silver iodide, and said central part has a silver iodide content of 0 to 5 mol %.

7. A silver halide photographic material as claimed in claim 5, wherein said central part accounts for not more than 10% of the whole grain.

8. A silver halide photographic material as claimed in claim 1, wherein said silver halide grains are tubular grains having two sheets of parallel twin planes.

9. A silver halide photographic material as claimed in claim 8, wherein said internal region exists in a region on the side nearer the apex from the surface of a cylinder formed by a circle with a radius of ⅓ of the distance between adjoining apexes on the principal plane of the tabular grains and formed by extending the circle in the direction of the thickness of the grain.

10. A silver halide photographic material as in claim 1, wherein more than 95% of the total projected area of said silver halide grains comprises tabular silver halide grains, said tabular silver halide grains having (i) two sheets of twin planes parallel to the principal plane, and (ii) a monodisperse size distribution.

11. A process for producing silver halide photographic material which comprises the steps of:

(1) adding a first solution containing iodide ions to a second solution containing silver iodobromide host grains; and (2) adding a third solution containing silver ions to the mixture from step (1) to form silver halide grains consisting essentially of (i) a central part, (ii) a circumferential region surrounding said central part, and (iii) an internal region formed in one or more corners in the circumferential region, said internal region having a silver iodide content higher than the silver iodide content of said circumferential region.

12. A process for producing a silver halide photographic material which comprises the steps of:

(1) adding a first solution containing iodide ions to a second solution containing silver iodobromide host grains; and (2) adding a third solution containing silver ions to the mixture from step (1) to form silver halide grains consisting essentially of:

(i) a central part, (ii) a circumferential region surrounding said central part, and (iii) an internal region formed in one or more corners in the circumferential region, said internal region having a silver iodide content higher than the silver iodide content of the circumferential region; and wherein more than 95% of the total projected area of said silver grains are tabular silver halide grains, said silver halide grains having (i) two sheets of twin lanes parallel to the principal plane, and (ii) a monodisperse size distribution.

13. A process for producing a silver halide photographic material as claimed in claim 11, wherein said step (2) is commenced at least one second after said step (1) is completed.

* * * * *